US007374808B2

(12) United States Patent
Sellman, Jr. et al.

(10) Patent No.: US 7,374,808 B2
(45) Date of Patent: May 20, 2008

(54) PATTERNED BONDED CARPET AND METHOD

(75) Inventors: N. David Sellman, Jr., LaGrange, GA (US); Kyle T. Veatch, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 107 days.

(21) Appl. No.: 09/906,282

(22) Filed: Jul. 16, 2001

(65) Prior Publication Data

US 2002/0046433 A1 Apr. 25, 2002

Related U.S. Application Data

(60) Provisional application No. 60/219,979, filed on Jul. 21, 2000.

(51) Int. Cl.

| | |
|---|---|
| ***B32B 33/00*** | (2006.01) |
| ***B32B 37/00*** | (2006.01) |
| ***D06B 1/02*** | (2006.01) |
| ***D06B 11/00*** | (2006.01) |

(52) U.S. Cl. ..... 428/94; 428/95; 428/92; 428/196; 8/150; 8/929; 8/499; 347/105; 347/106; 156/72; 156/250; 156/269; 156/270

(58) Field of Classification Search ..... 428/92, 428/94, 95, 93, 196; 8/150, 929, 484, 485, 8/499; 347/105, 106, 101, 107; 156/72, 156/250, 269, 270, 435

See application file for complete search history.

(56) References Cited

U.S. PATENT DOCUMENTS

| | | | | |
|---|---|---|---|---|
| 3,969,779 A | | 7/1976 | Stewart, Jr. | 8/149 |
| 4,022,941 A | | 5/1977 | Prokai et al. | 427/358 |
| 4,089,717 A | | 5/1978 | Fay | 156/72 |
| 4,132,817 A | | 1/1979 | Tillotson | 15/250.04 |
| 4,159,892 A | * | 7/1979 | Blumenaus | 8/478 |
| 4,171,395 A | | 10/1979 | Tillotson | 428/95 |
| 4,188,216 A | * | 2/1980 | Blumenaus | 430/22 |
| 4,353,706 A | | 10/1982 | Burns, Jr. et al. | 8/114.6 |

(Continued)

FOREIGN PATENT DOCUMENTS

EP 48986 A1 * 4/1982

(Continued)

OTHER PUBLICATIONS

L. Shoshkes, Contract Carpeting, 1974, Watson-Guptill Publications, pp. 27, 28, 32, 39 and 140.*

(Continued)

*Primary Examiner*—Cheryl Juska
(74) *Attorney, Agent, or Firm*—Terry T. Moyer; Daniel R. Alexander

(57) ABSTRACT

Color, pattern, design, and/or the like is applied by means of a jet dye process, or any other secondary or post pattern application process, including but not exclusively, silk screen printing, rotary printing, etc., to a bonded carpet, where the yarn in the carpet is all white (no dye applied) or light colored or where the yarn is pre-dyed with a single or multiple colors or where the yarn is treated chemically. The bonded carpet preferably has a low face weight and flat, short, dense, vertical cut pile.

18 Claims, 6 Drawing Sheets

U.S. PATENT DOCUMENTS

| | | | | | |
|---|---|---|---|---|---|
| 4,512,831 | A | | 4/1985 | Tillotson | 156/78 |
| 4,522,857 | A | | 6/1985 | Higgins | 428/95 |
| 4,979,380 | A | * | 12/1990 | Robbins et al. | 68/205 R |
| 4,984,181 | A | * | 1/1991 | Kliman et al. | 345/606 |
| 5,033,700 | A | * | 7/1991 | Robbins et al. | 248/49 |
| 5,035,018 | A | * | 7/1991 | Robbins et al. | 8/150 |
| 5,104,693 | A | | 4/1992 | Jenkines | 427/244 |
| 5,175,038 | A | * | 12/1992 | Tung et al. | 428/92 |
| 5,198,277 | A | * | 3/1993 | Hamilton et al. | 428/92 |
| 5,443,881 | A | * | 8/1995 | Higgins et al. | 428/93 |
| 5,540,968 | A | | 7/1996 | Higgins | 428/95 |
| 5,545,276 | A | | 8/1996 | Higgins | 156/79 |
| 5,560,972 | A | * | 10/1996 | Blakely et al. | 428/95 |
| 5,567,257 | A | * | 10/1996 | Higgins et al. | 156/72 |
| 5,616,200 | A | * | 4/1997 | Hamilton et al. | 156/72 |
| 5,616,210 | A | * | 4/1997 | Hamilton et al. | 156/435 |
| 5,693,400 | A | * | 12/1997 | Hamilton et al. | 428/89 |
| 5,763,076 | A | * | 6/1998 | Coons et al. | 428/364 |
| 5,939,166 | A | * | 8/1999 | Cheng et al. | 428/92 |
| 5,948,500 | A | | 9/1999 | Higgins | 428/95 |
| 6,089,007 | A | * | 7/2000 | Hamilton et al. | 57/14 |
| 6,203,881 | B1 | | 3/2001 | Higgins | 428/95 |
| 6,332,253 | B1 | * | 12/2001 | Rasnick et al. | 28/258 |
| 6,542,258 | B1 | * | 4/2003 | Garcia et al. | 358/1.9 |
| 6,704,610 | B2 | * | 3/2004 | West et al. | 700/133 |
| 6,742,869 | B2 | * | 6/2004 | Redding et al. | 347/43 |
| 6,792,329 | B2 | * | 9/2004 | Adams et al. | 700/133 |
| 6,793,309 | B2 | * | 9/2004 | McCay et al. | 347/15 |
| 6,854,146 | B2 | * | 2/2005 | Stoyles et al. | 8/150 |
| 6,884,493 | B2 | * | 4/2005 | Magee et al. | 428/175 |
| 7,014,665 | B2 | * | 3/2006 | Kang et al. | 8/484 |
| 7,072,733 | B2 | * | 7/2006 | Magee et al. | 700/133 |
| 2002/0012764 | A1 | * | 1/2002 | Magee et al. | 428/97 |
| 2002/0034607 | A1 | * | 3/2002 | Stoyles | 428/95 |
| 2003/0058250 | A1 | * | 3/2003 | Adams et al. | 345/589 |
| 2003/0060918 | A1 | * | 3/2003 | West et al. | 700/133 |
| 2003/0091214 | A1 | * | 5/2003 | Gould | 382/111 |
| 2004/0121115 | A1 | * | 6/2004 | Bridges et al. | 428/97 |
| 2004/0175534 | A1 | * | 9/2004 | Bridges et al. | 428/92 |
| 2004/0196346 | A1 | * | 10/2004 | Redding et al. | 347/100 |
| 2004/0196347 | A1 | * | 10/2004 | Redding et al. | 347/100 |
| 2005/0056337 | A1 | * | 3/2005 | Magee et al. | 139/399 |
| 2005/0106355 | A1 | * | 5/2005 | Kohlman et al. | 428/85 |

FOREIGN PATENT DOCUMENTS

| | | | |
|---|---|---|---|
| EP | 0 435 542 | A2 | 3/1991 |
| GB | 1 448 620 | | 8/1976 |
| WO | WO 200196643 | A2 * | 12/2001 |

OTHER PUBLICATIONS

"Contract Carpeting", Shoshkes, 1974 pp. 27, 28, 32, 39, 140.

* cited by examiner

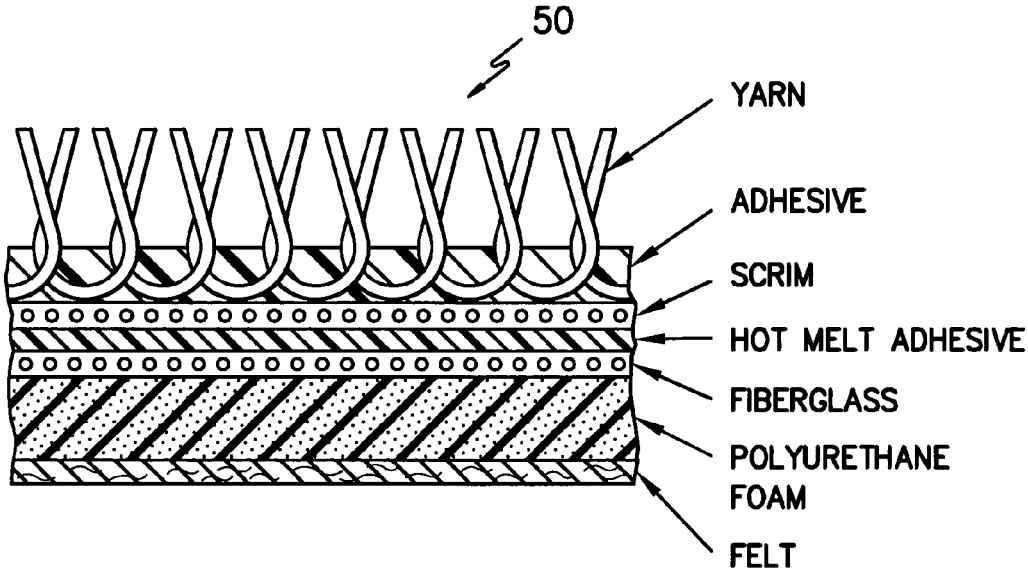
FIG. –10–
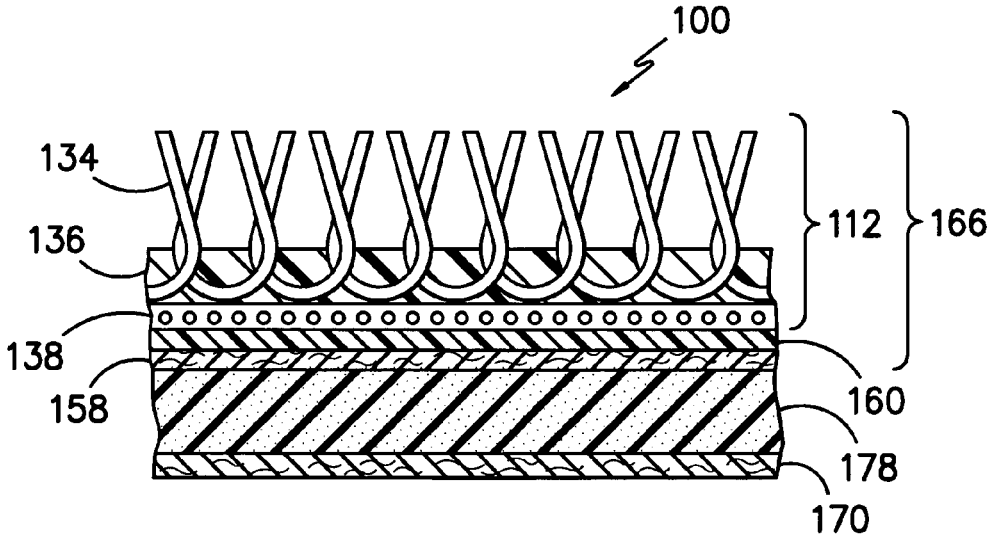
FIG. –11–

PATTERNED BONDED CARPET AND METHOD

CROSS-REFERENCE TO RELATED APPLICATIONS

This application claims priority to and benefit of U.S. Provisional Patent Application Ser. No. 60/219,979, filed Jul. 21, 2000, hereby incorporated by reference herein.

FIELD OF THE INVENTION

The present invention is directed to applying color, pattern, design, and/or the like by means of a jet dye process, or any other secondary or post pattern application process, including but not exclusively transfer printing, silk screen printing and rotary printing, etc., to a bonded carpet, where the yarn in the carpet is all white (no dye applied) or a light color or where the yarn is treated chemically or where the yarn is pre-dyed with a single or multiple colors. The bonded carpet preferably has a face weight of less than 25 oz/yd$^2$.

When carpets are woven, the design is created by locking pre-colored (Skein Dyed) yarn into a warp and weft weaving construction. The design or face pile and backing are literally created at one and the same time as the loom operates. Although the results are a beautiful carpet, there is a significant draw back, in that if one wishes to make the carpet in a lower price point (looser construction, lighter weight, etc.) then the aesthetic detail of the design will deteriorate significantly. Looser, cheaper, lighter, and lower price point are all common terms used when referring to a carpet construction of approximately 22 to 24 oz in weight, 2/56 yarn count, 0.25 inch pile height, and 7 pick/ends by 5 row construction.

To create a lower cost carpet, the weaver must reduce the materials used in the carpet, in other words a looser construction. In so doing, the dots per inch are also reduced and the design detail is greatly effected. Usually, the cheaper the carpet the cheaper looking it is.

A typical, low priced woven carpet construction, is about 5 rows by 7 pick/ends, or 35 dots per inch. Therefore, the very low dots per inch (DPI) matrix gives the design motifs a ragged or blocky look because the dots per inch are so large.

The final result is a product with less market appeal, "Cheap Looking Carpet."

The aspect ratio of dots per inch is arbitrary. This is again an outcome of the design being locked into the weave. The standard warp setting on a loom is fixed, typically 7 ends (picks) per inch. The weft is variable, say 5, 6, 7, 8, 9, 10 rows per inch. Therefore, to change the density of the carpet, (thicker or thinner, more or less expensive, etc.) you would create the weave thus, 5 rows by 7 ends (35 DPI) which would be an inexpensive carpet or, 10 rows by 7 ends, (70 DPI) which would be a very expensive carpet. Very expensive, good quality, high end, and higher price point are all common terms for a carpet construction which is approximately 32-36 oz in weight, 2/56 yarn count, 0.50 inch pile height, and 7×8 to 7×10 rows and picks per inch.

The problem is, there is an aspect ratio in the dots per inch. They are not square dots but rectangles, for example a 7 row by 7 ends is a square dot, but a 10 row by 7 ends is a rectangular dot. This causes problems when weaving for example, a rug.

When the aspect ratio of the dots is a rectangle, the woven rug can only be woven in one direction. To turn the rug at 90° to maximize the use of the carpet web, would distort the design in either the length or width directions. The only dot matrix that might work is the 7×7 square dot but then one would be tied into only one price point when weaving rugs.

The same design cannot be created on multiple weave constructions. Since the design and weave construction are inseparable, you cannot create the same design on different woven price points (constructions, heavier, lighter, etc. as described above). Obviously, if a design is created on a 10×7 DPI, it cannot be the same when transferred onto a 5×7 DPI, because of the loss of detail, only a facsimile can be made.

If one is weaving carpet on a loom, one can only weave a single construction at a time. It is not possible to make running changes to the construction of a woven carpet, either to change its weight or texture from cut to loop pile. In other words, it is possible only to make one price point (construction, heavier, lighter, etc.) or pile type of carpet at a time on one loom. To alter the construction or pile type, the loom must be stopped and adjusted, thus creating significant inefficiencies.

The new method of the present invention eliminates or addresses all of the three-fold problems previously mentioned and takes advantage of a bonded verses a woven or tufted carpet.

In accordance with one embodiment of the present invention, a bonded white yarn carpet is passed under a jet-dye patterning applicator by means of a conveyor. Such a jet-dye machine and process is described in U.S. Pat. No. 3,969,779 hereby incorporated by reference. The carpet passes under the jet-dye gunbars of a given number. Each gunbar holds a different dye color. Using design software, the jets shoot dye onto the carpet and form designs and patterns of infinite variety and color. The dyes are then fixed, washed, dried and finished. The advantage of the present invention is that the design or patterning is a separate and independent process, from the construction of the bonded carpet itself. Dots per inch can now be determined independently of the carpet so that bonded carpets of various weights, constructions, thickness, etc., can have designs applied to them that are of a consistently fine detail. For example, a design can now be created using a DPI of for example, 10×10, 20×20, 40×40, or 60×60 and applied to a bonded carpet with a low face weight and the design will no longer look cheap and ragged. Also, a DPI of 20×20 (400) or 40×40 (1600), cannot be made on a conventional weaving loom. 16×7 or 112 DPI is the maximum for conventional weaving looms.

Since the design application of the present invention is independent of the carpet construction, the aspect ratio can be a square, for example 20×20 DPI or 10×10 DPI. Therefore designs of all types, including rugs, runner and borders can be turned at 90° to maximize the utilization of the bonded carpet base, without design distortion.

The same design can be created on multiple weave constructions. Since the design application of the present invention is independent of the carpet construction, the exact same design can be placed on any bonded carpet and it can be done in the same run without stopping the design applicator, thus significantly improving efficiencies over the old method.

One object of the invention is to create a low weight fusion bonded carpet tile with white, undyed yarn that is 100% colored (dyed) in piece dye tile form with consistent uniformity and good seamability. Also, the water based latex adhesive used in the bonding process allows greater precision in the degree of penetration of the adhesive up the stalk of yarn. This degree of penetration effects how much yarn is available to be dyed by the patterning process. The dye penetrates down the yarn stalk and stops where it meets the latex. The low face weight and high degree of penetration of the latex provides a limited amount of yarn available for dyeing. This keeps the dye near the surface of the yarn yielding bright colors and very distinct pattern clarity or definition. This high degree of latex penetration also keeps the yarn stalk fairly stiff and erect. This stiff, erect pile orientation keeps the yarn in place at the tile edges which allows the carpet tiles to be dyed preferably with pattern and installed with the tile joints being visually imperceptible. This good seamability characteristic is highly desirable in installed carpet tile so that the carpet looks more like seamless broadloom carpet rather than individual modular tile squares.

Modifications can be made in accordance with the present invention. For example, the method or equipment for fusion bonding of the white yarn can vary, different types of adhesives can be used to bond the yarn, different primary backings or substrates can be used to hold the yarn and the adhesive, and different ways of folding the yarn to make carpet can be used. In accordance with the invention, it is preferred to use a water based latex adhesive, because other adhesive technologies may not allow the degree of control of penetration up the yarn stalk during the bonding process.

The method or equipment for application of the dye to form the color can vary. There can be different colors, dye stuff types, dye formulas, and different patterns of color. Different carpet patterning machines can be used to apply the color to the white or light carpet tile.

Also, although it is preferred to use white yarn, it is contemplated that other colors such as a light beige can be used.

Further, a clear dye or light beige dye can be used in patterning the image or design on the carpet tile so that all of the exposed pile is dyed to avoid areas of white undyed pile which may tend to stain or show dirt.

BRIEF DESCRIPTION OF THE DRAWINGS

FIG. 10 is a cut-away side view of a respective bonded low weight carpet composite or tile having a bonded carpet made up of yarn, adhesive, and scrim, a reinforcing or resilient layer of hot melt adhesive and fiberglass, and a cushion backing of polyurethane foam on felt.

FIG. 11 is a cut-away side view of a bonded carpet product like that of FIG. 10.

DETAILED DESCRIPTION

Figure 1:
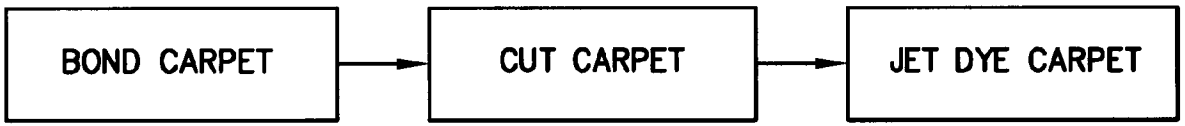
FIG. 1 is a schematic view illustrating one embodiment of the process of the present invention.

In one embodiment, the present invention is directed to a low face weight fusion bonded cut pile patterned carpet tile.

The preferred elements of an exemplary embodiment of the invention are:

1. A carpet tile
2. Uses white yarn
3. Fusion bonded with a water based latex adhesive
4. Low face weight (bonded less than 25 oz/yd)
5. Controlled adhesive penetration up into the face yarn
6. Erect stiff pile
7. Feathered edges during patterning Selected benefits of the invention are:

1. Good seamability
2. Excellent pattern clarity
3. Good Color yield
4. Face performance at low weight In accordance with a preferred embodiment of the present invention, there is provided a fusion bonded carpet tile made with white, undyed yarn that can be 100% colored with dye applied by an injection dyeing or jet dyeing patterning process. This white bonded tile is preferably constructed with a low yarn face weight (less than 25 oz/yd$^2$). Also, the face construction lends itself to patterning in such a way that the dye applied by, for example, jet dyeing or injection dyeing is uniform across the surface of the carpet tile without nonuniformities, visible at the tile edges.

With respect to FIG. 1 of the drawings, and in accordance with one embodiment of the present invention, the carpet substrate is bonded, the carpet substrate is cut into selected pieces, tiles, or the like, then each of the cut pieces or blanks is dyed or printed.

Figure 2:
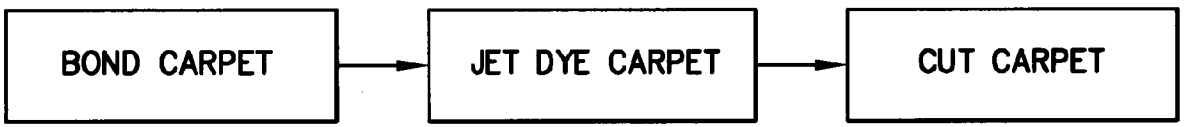
FIG. 2 is a schematic view representing another embodiment of the process of the present invention.

With reference to FIG. 2 of the drawings and in accordance with another embodiment of the present invention, the carpet substrate is bonded, then the substrate is jet dyed with particular colors, patterns, designs, and/or the like, then particular rugs, area rugs, runners, tiles, and the like are cut from the bonded dyed carpet.

Figure 3:
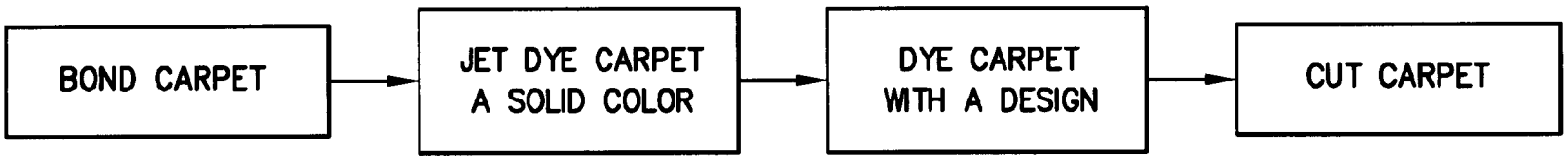
FIG. 3 is a schematic view representing another embodiment of the process of the present invention.

Although it is preferred to dye the background color and design or pattern of the rug or carpet in a single step as shown in FIGS. 1 and 2, with reference to FIG. 3 of the drawings and in accordance with another embodiment of the present invention, the carpet substrate is bonded, the carpet is dyed with a, for example, solid background color, then it is dyed or printed (over printed) with a pattern or design, and then it is cut into rugs, tiles, etc. Alternatively, the undyed bonded substrate can have the pattern applied to it with dyes that have resist chemistry, then the background shade can be applied in line with an overflow applicator or the background shade can be applied as a separate step in a "Beck Dye" applicator.

If the end product is, for example, an area rug, one can apply an edging, ribbing, piping or surging by gluing, sewing, or otherwise attaching the edging thereto.

Figure 4:
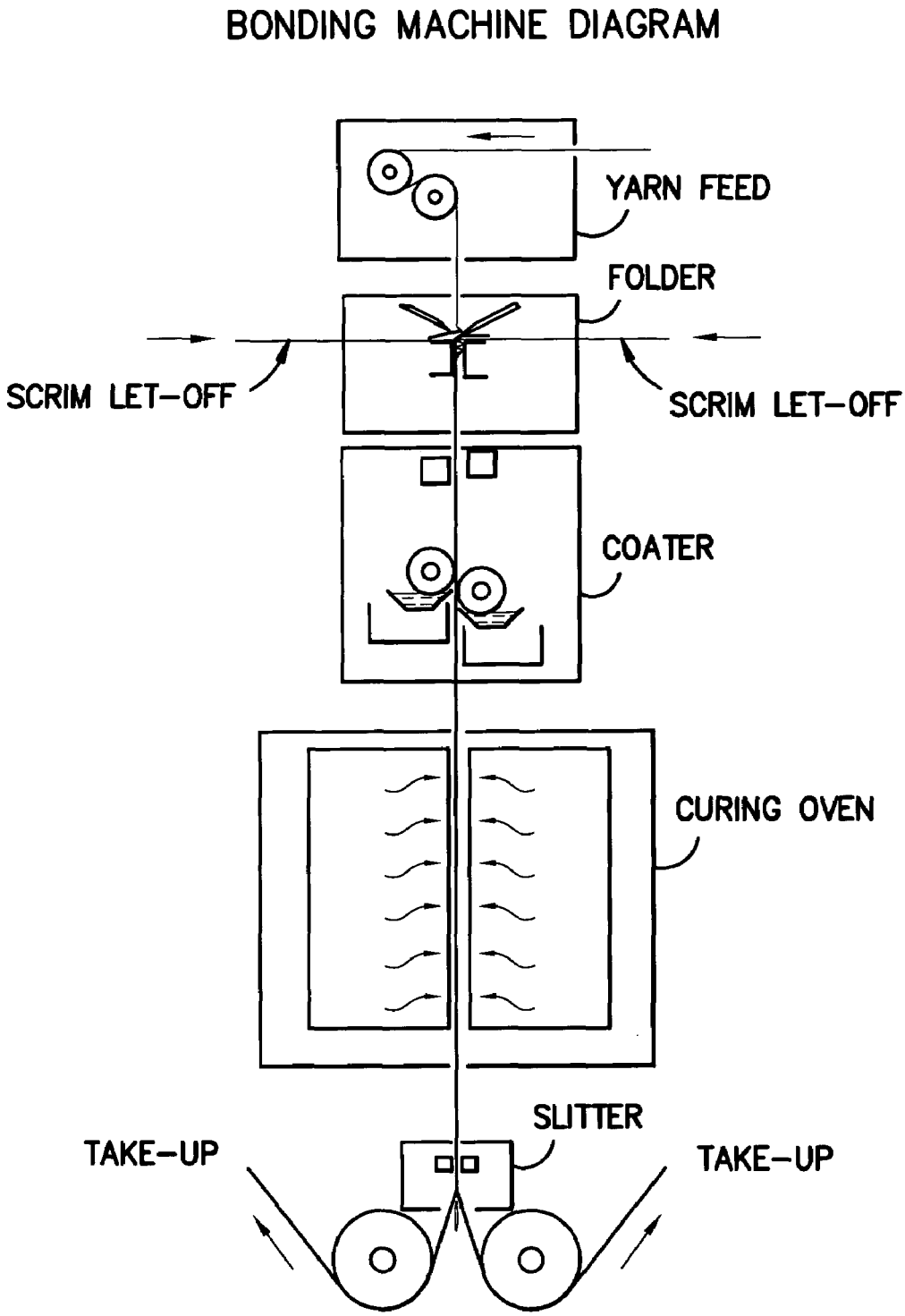
FIG. 4 is a schematic view illustrating the construction of bonded carpet.

With reference to FIG. 4 of the drawings, there is shown an exemplary bonding process.

In accordance with a preferred embodiment of the present invention and FIG. 4 of the drawings, white spun nylon yarn in a two ply construction is introduced into a fusion bonding machine for fabric formation of cut pile bonded carpet (yarn feed). This yarn could also be unplied singles or a three-ply yarn. The yarn is mechanically folded between two webs of an open mesh fiberglass scrim (folder). A latex adhesive is applied to the scrim and yarn on both sides (coater). The adhesive is used to bond the yarn to the scrim. The adhesive is then dried with a hot air oven (curing oven). This composite is then split in the center of the yarn sandwich to form two cut pile bonded carpets (slitter) and rolled up into two rolls of bonded carpet (take-up). The face of the carpet is then sheared to give the face yarn (cut pile) a clean, smooth, consistent finish. The back of the carpet is then laminated to at least one secondary backing and cut into modular carpet tile squares or blanks. The backing is typically a polyurethane cushion but it can be a different foam or resilient backing, such as, SBR, PVC, felt, etc., or it can be a hardback made of polymer film, bitumen film, or a polyvinyl chloride plastisol. The backing could also be a reinforcing layer and a cushion backing. Such a reinforcing layer could be a glass scrim or mat with a hot melt adhesive or polyurethane laminate.

The cut, bonded carpet tiles or blanks with a white face yarn are then dyed with a jet dye or injection dyeing patterning process. This is a dye injection process where different colors are applied to the face of the carpet tile with tiny dyejets. The carpet tile is then steamed in a saturated steam cloud for approximately four minutes to permanently fix the colored dyestuff into the yarn fiber. Next the carpet tile is washed to remove any unfixed dyes as well as auxiliary chemicals used with the dyes to aid the dyeing process. The carpet tile is next dried in a hot air oven where hot air is blown onto the face of the tile to remove the moisture. The hot air is typically blown at high velocity. The patterned carpet tiles are then cooled, sheared, trimmed, packaged, and shipped.

One object of the invention is to create a low weight fusion bonded carpet tile with white, undyed yarn that is 100% colored (dyed) in piece dye tile form with consistent uniformity and good seamability. Also, the water based latex adhesive used in the bonding process allows greater precision in the degree of penetration of the adhesive up the stalk of yarn. This degree of penetration effects how much yarn is available to be dyed by the patterning process. The dye penetrates down the yarn stalk and stops where it meets the latex. The low face weight and high degree of penetration of the latex provides a limited amount of yarn available for dyeing. This keeps the dye near the surface of the yarn yielding bright colors and very distinct pattern clarity or definition. This high degree of latex penetration also keeps the yarn stalk fairly stiff and erect. This stiff, erect pile orientation keeps the yarn in place at the tile edges which allows the carpet tiles to be dyed and installed with the tile joints being visually imperceptible. This good seamability characteristic is highly desirable in installed carpet tile so that the carpet looks more like seamless broadloom carpet rather than individual modular tile squares.

| | Low Weight Bonded Tile | | Standard Weight Bonded Tile | |
|---|---|---|---|---|
| | Preferred Number | Range | Preferred Number | Range |
| Yarn | 2 ply | single, 2 ply, or 3 ply | 3 ply | 2 ply, or 3 ply |
| Yarn Weight | 24 oz/yd$^2$ | 18 to 26 oz/yd$^2$ | 28 oz/yd$^2$ | 28 to 32 oz/yd$^2$ |
| Yarn Density | 10 fpi × 13.4 epi | Low: 9 fpi × 10 epi | 6.8 fpi × 8.45 epi | Low: 6.5 fpi × 8 epi |
| | | High: 15 fpi × 20 epi | | High: 8 fpi × 9 epi |
| Yarn Size | 3.15/2 | 2.01/1 to 3.6/3 | 1.92/3 | 2.1/2 or 2.1/3 to 1.85/2 or 1.85/3 |
| Pile Height | 0.205 inches | 0.190 to 0.220 inches | 0.245 inches | 0.240 to 0.280 inches |

fpi = folds per inch
epi = ends per inch

Modifications can be made in accordance with the present invention. For example, the method or equipment for fusion bonding of the white yarn can vary, different types of adhesives can be used to bond the yarn, different primary backings or substrates can be used to hold the yarn and the adhesive, and different ways of folding the yarn to make carpet can be used. In accordance with the invention, it is preferred to use a water based latex adhesive, because other adhesive technologies may not allow the same degree of control of penetration up the yarn stalk during the bonding process.

The method or equipment for application of the dye to form the color can vary. There can be different colors, dye stuff types, dye formulas, and different patterns of color. Different carpet patterning machines can be used to apply the color to the white carpet tile.

Also, although it is preferred to use white yarn, it is contemplated that other colors such as a light beige can be used.

Further, a clear dye or light beige dye can be used in patterning the image or design on the carpet tile so that all of the exposed pile is dyed to avoid areas of white undyed pile which may stain or show dirt.

In accordance with the present invention, the white bonded substrate may be formed of 2 ply yarn, 56 yards to the oz, 100% wool, 100% nylon or other post dyeable natural, synthetic or blend yarn, 80% nylon, 20% wool, or the like, and have a face weight of preferably less than 28 oz/yd$^2$, more preferably about 15-27 oz/yd$^2$, and may be bonded from a white or light yarn or a solid colored yarn which can be dyed or printed (over dyed or over printed) to produce the final effect. For example, when a white yarn is used to produce a white bonded carpet substrate or blank, the background color of the rug is printed along with the design or pattern if that color is not white. Alternatively, if the yarn is a dyed or colored yarn (solution dyed, yarn dyed, naturally colored, or the like), then the design or pattern is printed thereon, but the background color is already created by the yarn itself.

U.S. Pat. Nos. 6,203,881; 5,948,500; 5,540,968; 5,545,276; and 4,522,857 describe methods or processes forming cushioned carpet tile or carpet which is either tufted or bonded and are hereby incorporated by reference.

U.S. Pat. Nos. 5,567,257 and 5,443,881 disclose methods for forming heat stabilized bonded pile fabric wherein in at least one embodiment a bonded pile fabric of enhanced stability is formed using low levels of adhesive by tacking the yarn by heat fusion to an open weave base layer prior to application of adhesive. The adhesive which is preferably a low viscosity latex is applied through an open weave base layer to further bond the pile. An apparatus for making the bonded pile fabric is also provided. U.S. Pat. Nos. 5,567,257 and 5,443,881 are hereby incorporated by reference.

Figure 5:
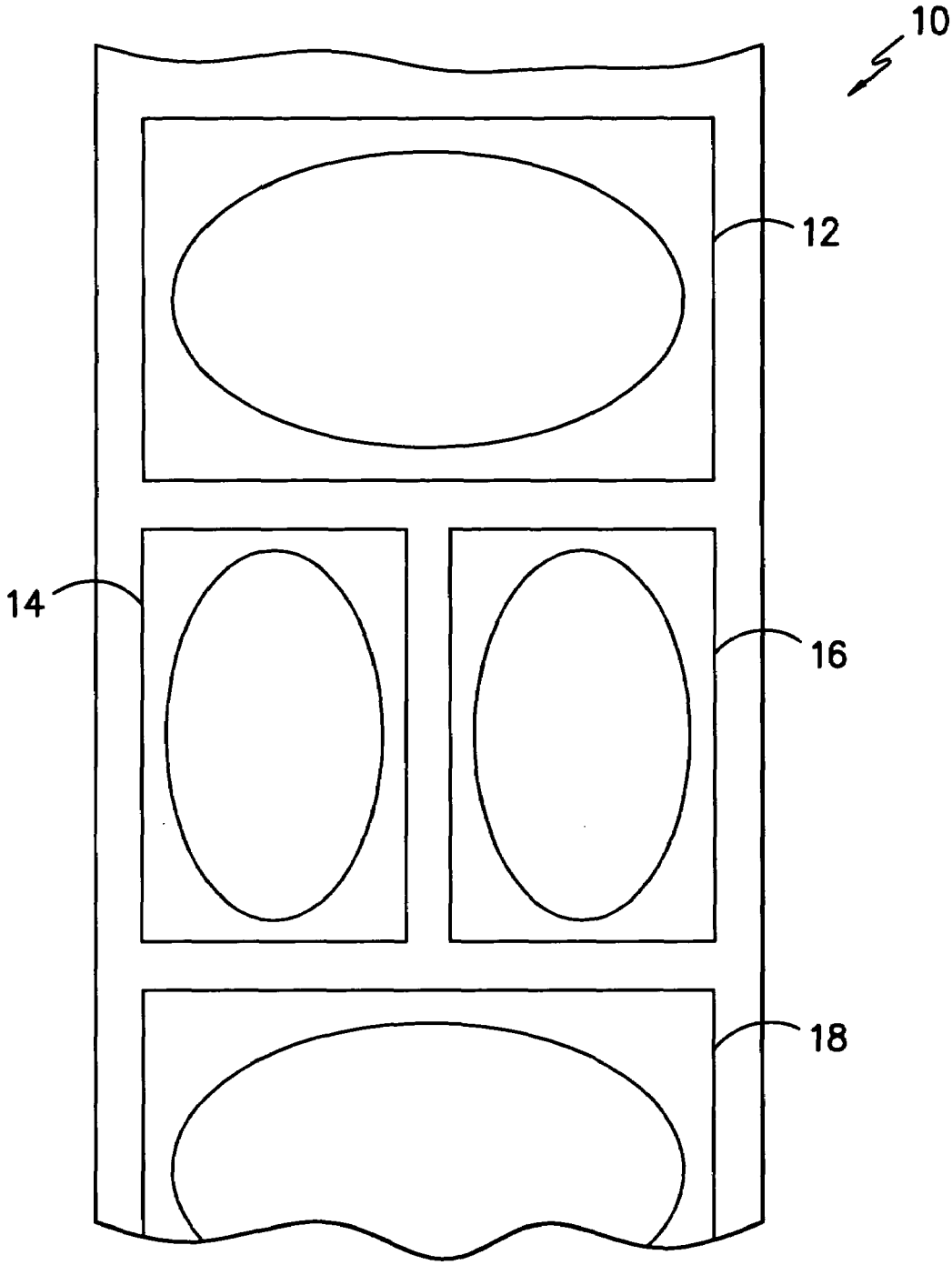
FIG. 5 is a schematic view representing a length of bonded carpet substrate (base) with designs printed thereon in different orientations, although the bonded carpet has a constant weave construction over its length.

As shown is FIG. 5 of the drawings, an unlimited variety of elements can be created on a single piece of bonded carpet substrate or base, for example, the area rug designs or patterns 12, 14, 16 and 18 on the bonded substrate 10. This bonded base can be, for example, 6 or 12 feet wide and 100 or 1000 feet long. This maximizes the efficiency of the process, minimizes cost, and provides for mass customization where the manufacturer, designer, printer, or the like can provide orders for one a or more items from a multitude of different customers one right after the other without shutting down the machinery. Proper nesting of the items on the base can provide for reduced waste.

Figure 6:
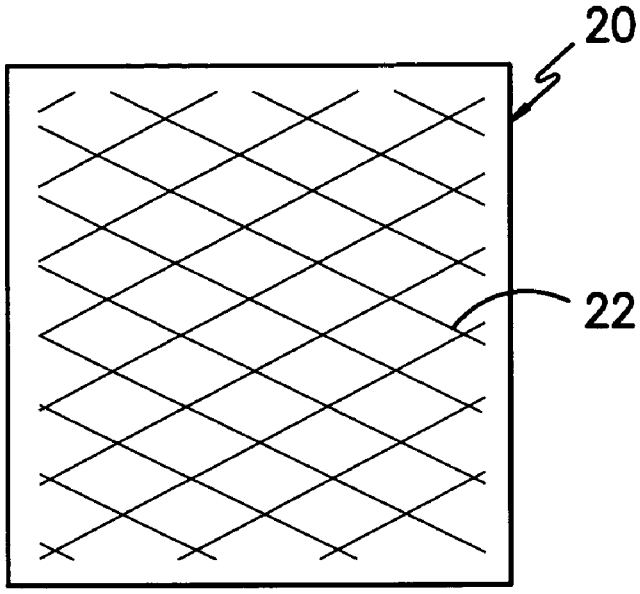
FIG. 6 is a schematic view illustrating a piece of carpet or carpet tile having a pattern printed thereon in accordance with the present invention.

With reference to FIG. 6 of the drawings, there is shown flooring 20, such as, a carpet tile, area rug, or the like having a design 22 printed or dyed thereon.

Figure 7:
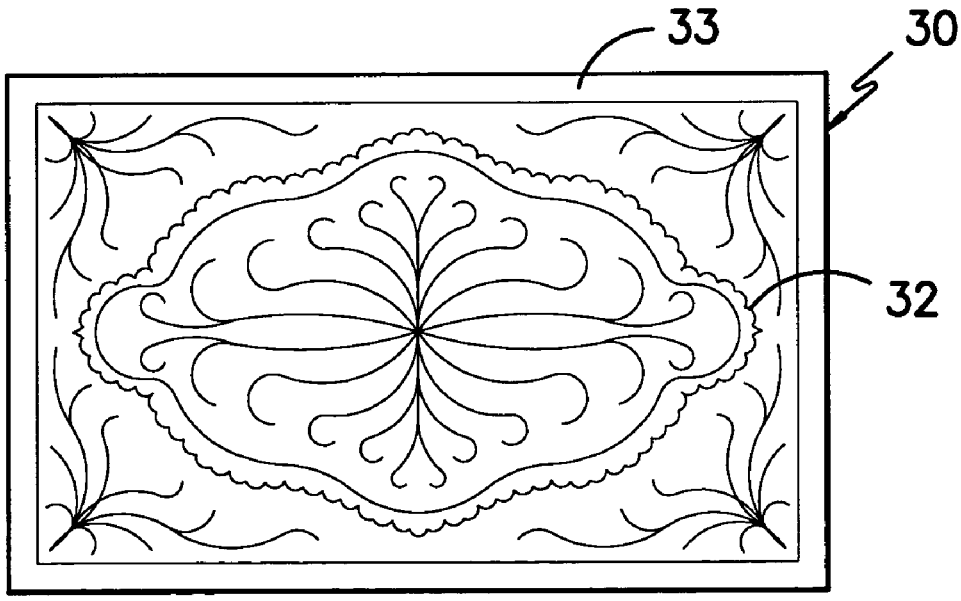
FIG. 7 is a schematic view representing a piece of carpet having a pattern printed thereon and also including a frame-like border printed thereon to provide for slight variations in registration of the design verses the cut of the rug from the bonded substrate.

With respect to FIG. 7 of the drawings, there is shown flooring, such as, a carpet tile, an area rug or runner 30 having a design 32 and an edge or border 33 printed thereon. By printing an edge or frame-like border 33 on the rug 30, and making the border of sufficient width, the manufacturer can accommodate slight variations in the registration of the design and the cutting equipment so that a customer will not notice if the design is slightly off registration or if the cut is slightly off of its intended location.

In accordance with the present invention, color, pattern, design, and/or the like is applied by means of a jet dye process, or any other secondary or post pattern application process, including but not exclusively transfer printing, silk screen printing, rotary printing, etc., to a bonded carpet, where the yarn in the carpet is all white (no dye applied) or light colored or where yarn is treated chemically or where the yarn is pre-dyed with a single or multiple colors. Although it is preferred to have the carpet fusion bonded with latex adhesive, the bonded carpet can be made with other conventional bonding processes.

Figure 8:
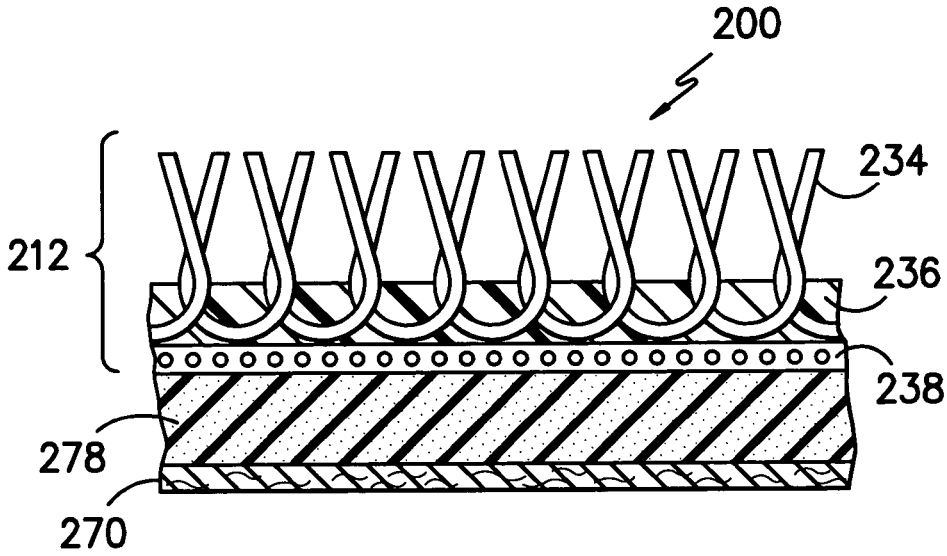
FIG. 8 is a cut-away side view of an exemplary embodiment of a bonded carpet having no reinforcement layer.

With reference to FIG. 8 of the drawings, a carpet composite or carpet tile 200 is shown having a bonded primary carpet 212 including a plurality of cut pile yarns 234 implanted in a latex or hot melt adhesive 236 which is laminated to a reinforcement or substrate layer 238 (scrim) of a woven or nonwoven material including fiberglass, nylon, polyester, polypropylene, or combinations thereof. A backing material 270 such as a nonwoven backing (felt) is coated with a polymer 278 such as a polyurethane-foaming composition.

Figure 9:
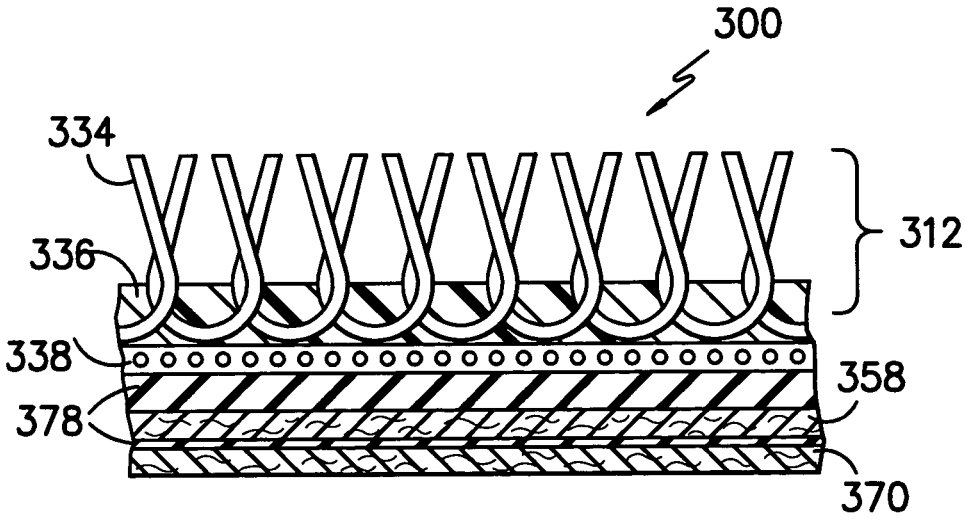
FIG. 9 is a cut-away side view of an alternative structure for a bonded carpet having a reinforcement material at least partially surrounded by or embedded in polyurethane.

With respect to FIG. 9 of the drawings, a bonded carpet substrate or carpet tile 300 is shown to include a primary bonded carpet 312 including a plurality of cut pile yarns 334 implanted in a latex or hot melt adhesive 336 which is laminated or attached to a reinforcement or substrate layer 338. Below the substrate 338 is a polyurethane foam 378 having therein a reinforcement material 358 such as a fiberglass scrim, for example a fiberglass nonwoven material such as a 2 oz/yd$^2$ fiberglass containing a urea formaldehyde binder, acrylic binder or the like, although alternative materials may include woven glass, woven polyester, nonwoven glass, nonwoven polyester, or combinations thereof supported atop felt 370.

As shown in FIG. 10 of the drawings and in accordance with one particular embodiment of the present invention, a bonded carpet substrate or composite 50, such as a carpet tile, includes a primary carpet of yarn, adhesive, and scrim, followed by a reinforcing layer of hot melt adhesive and fiberglass, which is followed by polyurethane foam supported on felt. Such a composite is preferably formed in a continuous process where the hot melt adhesive is applied to the fiberglass, the polyurethane foam is applied to the felt, and then all three of the bonded carpet, reinforcing layer, and foam layer are laminated together to form the completed composite shown.

Carpet and carpet tiles having cushion backings are known and described for example in U.S. Pat. Nos. 4,522,857; 5,540,968; 5,545,276; 5,948,500; and 6,203,881, all hereby incorporated by reference herein.

Preforming and curing the foam base of the composite of urethane foam and backing material is described, for example, in U.S. Pat. Nos. 4,171,395; 4,132,817; and 4,512,831, all hereby incorporated by reference herein.

A superior cushion backed carpet tile or modular cushion back tile on the market today, for example, sold under the trademark Comfort Plus® by Milliken & Company of LaGrange, Ga. has a primary carpet fabric with a face weight of about 20 to 40 oz/yd $^2$, a hot melt layer of about 38 to 54 oz/yd $^2$, a cushion of about 0.10 to 0.2 inches thick, with a weight of about 28 to 34 oz/yd$^2$, and with a density of about 18 lbs. per cubic foot, and has an overall product height of about 0.4 to 0.8 inches. This superior cushion back carpet tile provides excellent resilience and underfoot comfort, exhibits performance characteristics that rate it for very heavy commercial use, and has achieved a notable status throughout the industry as having excellent look, feel, wear, comfort, cushion, performance, and the like. Such a superior cushion back carpet tile is relatively expensive to produce due to the high quality and quantity of materials utilized therein.

With respect to FIG. 11 of the drawings, a bonded carpet substrate or carpet tile 100 in accordance with one embodiment with the present invention includes a primary carpet fabric 112 having a plurality of cut pile yarns 134 implanted in an adhesive 136 such as a latex or hot melt adhesive which is laminated to or supported by a substrate layer 138 of a woven or nonwoven material. The yarns 134, 234, or 334 may be either spun or filament yarns and are preferably formed from a polyarnide polymer such as nylon 6 staple, nylon 6 filament, nylon 6,6 staple, nylon 6,6 filament, or the like available from companies like DuPont in Wilmington, Del. Although other suitable natural or synthetic yarns or blends may likewise be employed. By way of example only and not limitation, other materials which might be used include polyester staple or filament such as polyethylene terephthalate (PET), polybutalene terephthalate (PBT), polyolefins such as polyethylene and polypropylene staple or filament, rayon, and polyvinyl polymers such as polyacrylonitrile. A variety of deniers, plies, twist levels, air entanglement, and heat set characteristics may be used to construct the yarn. The preferred material is nylon 6,6, staple, 3.15 cotton count, 2 ply, twisted, heat set. Other materials may be used such as nylon 6,6, filament, 1360 denier, 2 ply, twisted.

The primary carpet 112 (FIG. 11) is attached to a adhesive 160 such as a hot melt adhesive applied to a reinforcement material 158 such as a nonwoven fiberglass material to form preliminary composite 166 which is thereafter attached to or laid into a puddle of polyurethane-forming composition 178 atop a backing material 170 such as felt.

The preferred polyurethane-forming composition is disclosed in U.S. Pat. No. 5,104,693, hereby incorporated by reference. The polyurethane-forming composition also preferably contains a silicone surfactant to improve frothability and stability in the form of an organo-silicone polymer such as are disclosed generally in U.S. Pat. No. 4,022,941 hereby incorporated by reference.

In accordance with at least one embodiment of the present invention, there is provided a carpet substrate or blank especially adapted for dye injection printing and having a flat, short, dense, vertical pile. Such a substrate provides for high resolution, good color, dye injection printing and may provide for such printing with less dye and less bleeding of dye.

While the invention has been described and disclosed in connection with certain preferred embodiments and procedures, it is by no means intended to limit the invention to such specific embodiments and procedures. Rather it is intended to cover all such alternative embodiments, procedures, and modifications thereto as may fall within the true spirit and scope of the invention. For example, although a woven or non-woven backing or release material 270, 370, felt, and 170 is shown in each of FIGS. 8-11, it may be replaced with a film or composite (such as a self-stick composite of adhesive and film) or may be eliminated. It is, of course, to be appreciated that while several potentially preferred embodiments have been shown and described, the invention is in no way to be limited thereto, since modifications may be made and other embodiments of the principles of this invention will occur to those skilled in the art to which this invention pertains. Therefore, it is contemplated that the invention covers any such modifications and other embodiments as incorporate the features of this invention within the true spirit and scope thereof.

The invention claimed is:

1. A method of producing bonded flooring, comprising the steps of:

bonding a carpet substrate with a carpet yarn using a water based latex adhesive, wherein the carpet yarn is at least one of all white, light colored, pre-dyed with a single color, pre-dyed with multiple colors, naturally colored, and chemically treated to absorb dyes differently in arbitrary areas of the carpet to form a cut pile, fusion bonded carpet having a pile height of about 0.190-0.220 inches and a yarn density of about 9-15 folds per inch and 10-20 ends per inch, jet dyeing at least one of a background color, design, pattern, or border, on the fusion bonded carpet by applying liquid dye at a DPI greater than the DPI of the bonded carpet such that the applied dye migrates from terminal ends of the carpet yarn to the water based latex, and cutting or forming the jet dyed fusion bonded carpet into a completed item or product selected from the group consisting of carpet tiles, area rugs, runners, carpets, rugs, broadloom, and wall to wall carpet.

2. The method as recited in claim 1, wherein the fusion bonded carpet has a face weight of less than 28 oz/yd$^2$.

3. The method as recited in claim 1, wherein the DPI of an applied design is at least 10×10.

4. A dyed or printed bonded flooring product, selected from the group consisting of carpet tiles, area rugs, runners, carpets, rugs, broadloom, and wall to wall carpet produced by the process of claim 1.

5. A fusion bonded carpet selected from the group consisting of camel tiles, area rugs, runners, carpets, rugs, broadloom, and wall to wall carpet produced by the process of claim 1, wherein the fusion bonded carpet has a face weight of about 15-27 oz/yd$^2$.

6. A fusion bonded carpet according to claim 5, wherein the fusion bonded carpet has a face weight of about 24 oz/yd$^2$.

7. A fusion bonded carpet according to claim 5, wherein the carpet yarn is at least one of nylon, wool or blends thereof.

8. A fusion bonded carpet according to claim 7, wherein the carpet yarn is a 2 ply yarn.

9. A fusion bonded carpet according to claim 5 having a yam density of about 10 folds per inch and about 13.4 ends per inch.

10. A fusion bonded carpet according to claim 5, wherein the carpet yarn is a two ply yam having a cotton count linear density of about 3.15/2.

11. A fusion bonded carpet according to claim 5, wherein the pile height is about 0.205 inches.

12. A fusion bonded carpet produced by the process of claim 1, wherein the carpet yarn is selected from the group consisting of single ply, two ply and three ply yam.

13. A fusion bonded carpet produced by the process of claim 1 ,wherein the Garnet has a face weight of about 18-26 oz/yd$^2$.

14. A fusion bonded carpet produced by the process of claim 1, wherein the carpet yarn has a cotton count linear density in the range of about 2.01/1 to about 3.6/3.

15. A fusion bonded carpet produced by the process of claim 1, wherein the pile height is about 0.190 to about 0.220 inches.

16. The method as recited in claim 1, wherein the jet dyed fusion bonded carpet forms the face of a carpet tile.

17. A method of producing bonded flooring, comprising the steps of:

bonding a carpet substrate with a carpet yarn with a water based latex adhesive wherein the carpet yarn is all white to form a fusion bonded carpet having a face weight of less than 28 oz/yd$^2$ and a pile height of about 0.190-0.220 inches and a yarn density of about 9-15 folds per inch and about 10-20 ends per inch;

jet dyeing at least one of a background color, design, pattern, or border, on the fusion bonded carpet by application of a plurality of liquid dye droplets to the carpet yarn at a DPI greater than the DPI of the bonded carpet such that the applied dye migrates from terminal ends of the carpet yam to the water based latex;

and cutting or forming the jet dyed fusion bonded carpet into a completed item or product selected from the group consisting of carpet tiles, area rugs, runners, carpets, rugs, broadloom, and wall to wall carpet.

18. The method as recited in claim 17, wherein the jet dyed fusion bonded carpet forms the face of a carpet tile.

* * * * *

UNITED STATES PATENT AND TRADEMARK OFFICE

CERTIFICATE OF CORRECTION

PATENT NO. : 7,374,808 B2
APPLICATION NO. : 09/906282
DATED : May 20, 2008
INVENTOR(S) : N. David Sellman, Jr. and Kyle T. Veatch It is certified that error appears in the above-identified patent and that said Letters Patent is hereby corrected as shown below:

In column 10, line 2, after the word "of" and before the word "tiles", delete the word "camel" and add the word --carpet--.

In column 10, line 15, delete the word "yam" and add the word --yarn--.

In column 10, line 18, delete the word "yam" and add the word --yarn--.

In column 10, line 25, delete the word "yam" and add the word --yarn--.

In column 10, line 27, delete the word "Garnet" and add the word --carpet--.

In column 10, line 52, delete the word "yam" and add the word --yarn--.

Signed and Sealed this

Twentieth Day of January, 2009

JON W. DUDAS
*Director of the United States Patent and Trademark Office*